United States Patent [19]

Foley

[11] Patent Number: 4,749,357

[45] Date of Patent: Jun. 7, 1988

[54] CIRCUIT BOARD CONNECTOR, BUS AND SYSTEM

[75] Inventor: Robert G. Foley, Fremont, Calif.

[73] Assignee: Elcon Products International Company, Fremont, Calif.

[21] Appl. No.: 812,797

[22] Filed: Dec. 23, 1985

[51] Int. Cl.[4] ..... H01R 4/66

[52] U.S. Cl. ..... 439/80; 439/78; 439/65; 439/92; 439/851

[58] Field of Search ..... 339/14 R, 17 LC, 14 P, 339/17 LM, 17 M, 17 L, 256 RT, 256 R; 439/78–80, 81, 82, 66, 74, 75, 65, 92, 851, 852

[56] References Cited

U.S. PATENT DOCUMENTS

| | | | |
|---|---|---|---|
| 3,120,989 | 2/1964 | Solorow et al. | 339/256 R |
| 3,205,295 | 9/1965 | Davidson | 339/14 R |
| 3,287,517 | 11/1966 | Campbell | 339/14 R |
| 3,587,029 | 6/1971 | Knowles | 339/14 R |
| 3,617,992 | 11/1971 | Ruehlemann | 339/242 |
| 4,191,440 | 3/1980 | Schramm | 339/17 C |
| 4,418,972 | 12/1983 | Benasutti | 439/79 |
| 4,451,107 | 5/1984 | Dola et al. | 339/14 R |
| 4,510,553 | 4/1985 | Faultersack | 339/17 LC |
| 4,514,784 | 4/1985 | Williams et al. | 339/17 M |
| 4,616,893 | 10/1986 | Feldman | 339/14 R |
| 4,676,565 | 6/1987 | Reichardt | 439/79 |

FOREIGN PATENT DOCUMENTS

| | | | |
|---|---|---|---|
| 2479581 | 10/1981 | France | 339/17 LC |

*Primary Examiner*—Daniel C. Crane

*Attorney, Agent, or Firm*—Flehr, Hohbach, Test, Albritton & Herbert

[57] ABSTRACT

A power distribution connector (10) has an insulating block (12) with a bus element (14) supported by the insulating block (12). Contact pins (20) are attached to the bus element (14) and extend through the insulating block (12). An additional contact (38) is electrically connected to the bus element (14) and is configured to engage a mating contact (42).

15 Claims, 4 Drawing Sheets

CIRCUIT BOARD CONNECTOR, BUS AND SYSTEM

BACKGROUND OF THE INVENTION

1. Field of the Invention

This invention relates to a high current connector for circuit board interconnection, such as between a mother board and daughter board. It further relates to a bus structure incorporating such a connector for supplying high current to printed circuit boards and distributing it within the boards. It also relates to an interconnected system of two or more printed circuit boards which utilizes such a connector and/or bus structure.

2. Description of the Prior Art

In conventional printed circuit board technology, to bring power to a mother board or to distribute the power throughout a system of bus boards, back planes or the like, multicontact connectors must be used with a portion of their contacts bussed together to provide the current carrying capability. This method has drawbacks in that it is labor intensive as well as operator sensitive, i.e., all bussed connections must be reliable and exact.

Another common interconnect method is hard wiring. This means that discrete wires are permanently soldered to the devices, or that ring lugs are crimped to wires and then attached with a screw to the device. Again, these methods are very labor intensive and operator sensitive. These methods are also expensive in that materials, such as wire bundles, must be redundant to achieve the current capacities required.

Although these techniques have been in use for a number of years for printed circuit board connections, they suffer from a very recognizable drawback of poor field serviceability. The amount of time it takes for a technician to disconnect and reconnect boards, connectors, discrete lugged wires, power supplies, bus bars and the like, has a direct bearing on system operational costs to the user. This, coupled with the high degree of performance sensitivity to poor soldering, improperly torqued lug screws and similar assembly defects points to a need for further development of high current power distribution systems for printed circuit boards.

SUMMARY OF THE INVENTION

Accordingly, it is an object of this invention to provide an improved high current quick connect and disconnect power distribution connector, bus structure and system.

It is another object of the invention to provide such a connector, bus structure and system which utilizes parts that are interchangeable in different assemblies.

It is a further object of the invention to provide such a connector, bus structure and system which will allow essentially any board/board interplanar relationship.

It is still another object of the invention to provide a connector configuration which will space a bus bar a predetermined distance from a printed circuit board surface and provide a standardized pin interface configuration to the circuit board.

The attainment of these and related objects may be achieved through use of the novel connector, bus structure and system herein disclosed. A connector in accordance with this invention has an insulating block and a bus element supported by the insulating block. A plurality of contact pins are attached to the bus element and extend through the insulating block. An additional contact, which may either be a female contact within the insulating block or a male contact attached to and extending outward from the bus element, is electrically connected to the bus element. In a bus structure in accordance with the invention, the bus element extends between a plurality of the insulating blocks and is supported by each of the insulating blocks. An interconnected system in accordance with the invention has a plurality of printed circuit boards electrically connected with one or more connectors or bus structures in accordance with the invention.

The connector, bus structure and system of this invention provide power distribution in a manner that meets variable design applications and uses. The connector, bus structure and system of this invention can be configured with standard parts to fit a user's unique packaging and interface requirements.

The attainment of the foregoing and related objects, advantages and features of the invention should be more readily apparent to those skilled in the art, after review of the following more detailed description of the invention, taken together with the drawings, in which:

DETAILED DESCRIPTION OF THE INVENTION

Figure 1:
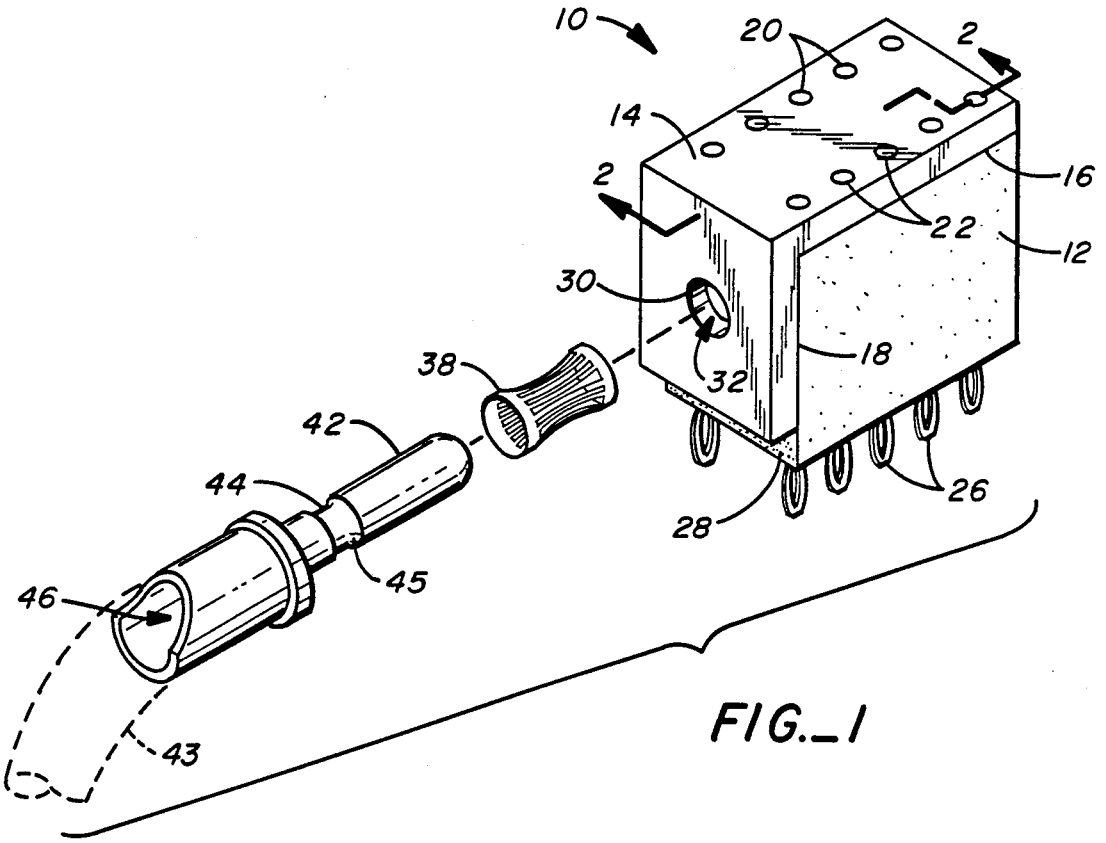
FIG. 1 is a partially exploded perspective view of a connector in accordance with the invention.
Figure 2:
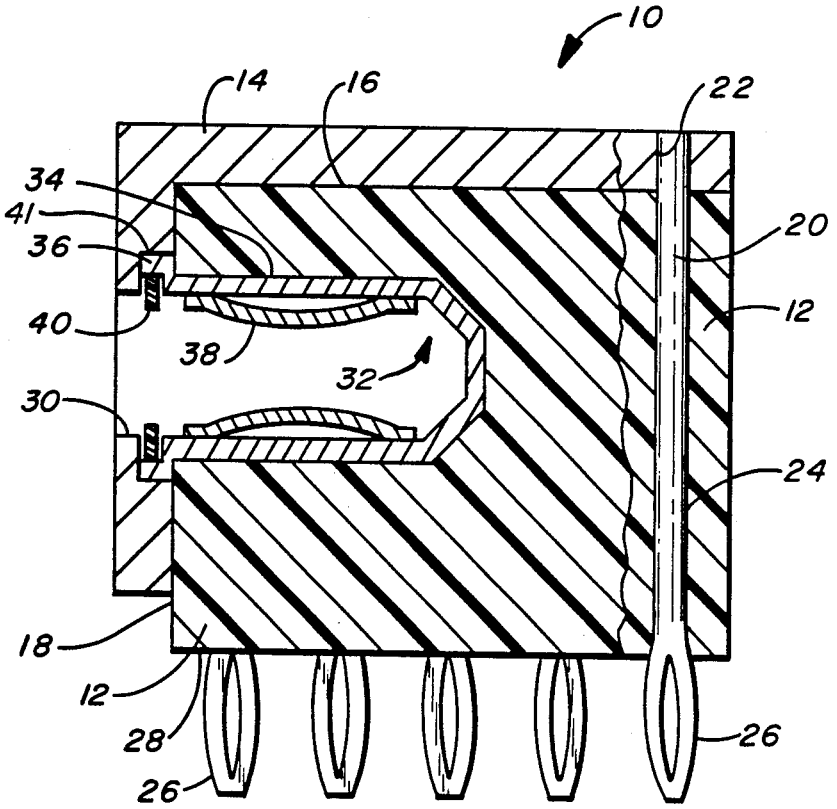
FIG. 2 is a cross section view taken along the line 2—2 in FIG. 1.

Turning now to the drawings, more particularly to FIGS. 1–2, there is shown a connector 10 in accordance with the invention. The connector 10 has an insulating thermoplastic body 12. A conductive brass or copper bus 14 extends along top 16 and side 18 of the insulating body 12. Compliant pins 20, formed from a beryllium-copper alloy, extend through apertures 22 in the bus 14 and passages 24 through the body 12. The pins 20 are attached to the bus 14 by solder reflow bonding. Compliant tips 26 of the pins 20 extend from bottom 28 of the body 12 in a standard 10-pin dual-in line-package (DIP) configuration for insertion in mating sockets on a printed circuit board (PCB).

Opening 30 in the bus 14 leads to socket 32 within the insulating base 12. A copper crown band housing 34 is inserted in the socket 32 and solder reflow bonded at its rim 36 to the bus 14. A crown band beryllium-copper spring alloy electrical contact 38 is friction fit in the crown band housing 34. An optional plastic locking split ring 40 for discrete pin contact 42 is mounted on the inside of rim 36.

Discrete pin contact 42 has a locking groove 44, which engages the locking ring 40 when the pin 42 is inserted in socket 32. A power cable 43 is soldered, crimped, attached with a pigtail connection or the like to end 46 of the pin contact 42. The locking mechanism is the separate plastic ring 40 which floats in a cavity 41 in the rim 36 of the contact housing 34 and which is also split to allow expansion when the pin contact 42 is either inserted or removed. The locking ring 40 has an inherent spring memory by design, material type and molding methods, which allow repeated insertions and withdrawals of the pin contact without wear or mechanical fatigue of the locking ring.

The snap lock feature provides two methods which confirm that the pin contact 42 is fully inserted. First, the installer "feels" the locking function when the lock ring snaps into the machined groove 44 in the pin contact. Second, the installer hears an audible "click" as the lock ring 40 snaps into the groove 44.

Although the locking mechanism retains the pin contact 42 and prevents it from being removed without a direct action to do so, the pin contact can be removed by pulling it straight away from the socket contact 38. The pin contact 42 has as part of its locking groove 44 a machined angle 45 on the forward part of the groove 44 to facilitate a starting ramp for the locking ring 40 to ride up and expand, thereby allowing the pin contact to be removed.

Figure 3:
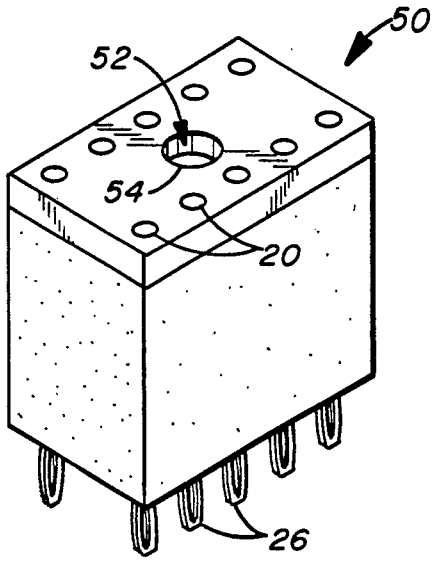
FIG. 3 is a perspective view of a second connector in accordance with the invention.

In the FIGS. 1–2 embodiment, socket 32 is at a 90 degree angle relative to the extending direction of the pins 20. FIG. 3 shows another connector 50 in accordance with the invention, in which socket 52 extends from opening 54 in bus 56 parallel to the extending direction of the pins 20. In other respects, the construction and operation of the FIG. 3 embodiment is the same as the FIGS. 1–2 embodiment.

Figure 4:
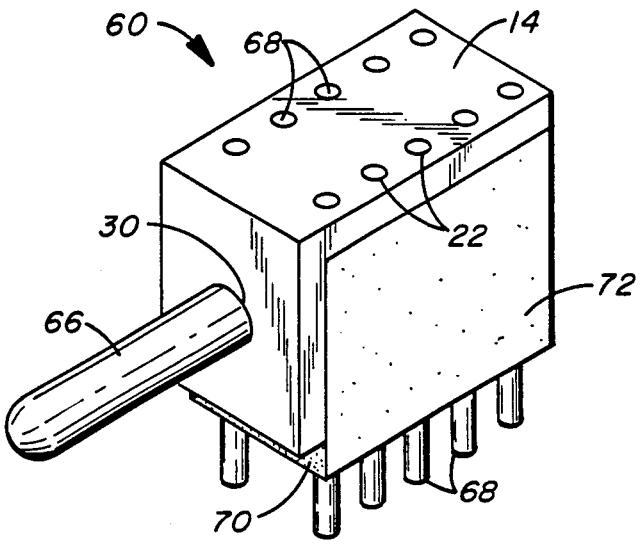
FIG. 4 is a perspective view of a third connector in accordance with the invention.
Figure 5:
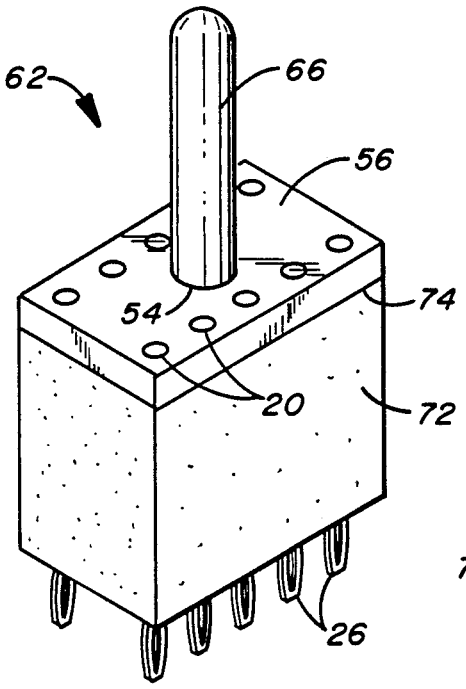
FIG. 5 is a perspective view of a fourth connector in accordance with the invention.
Figure 6:
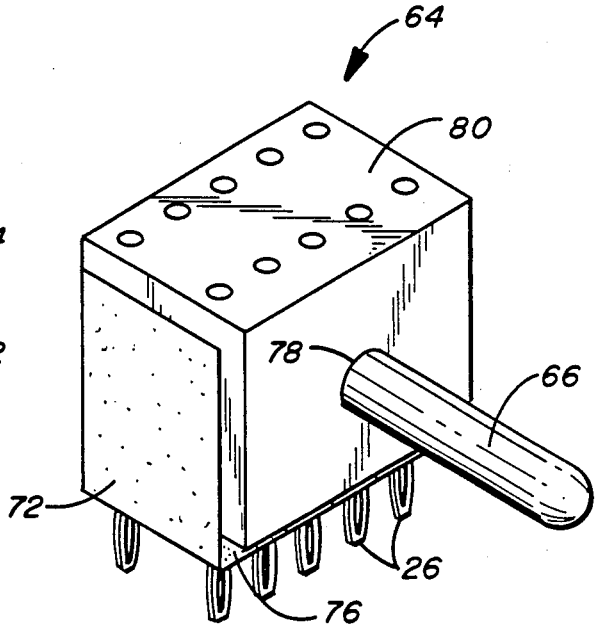
FIG. 6 is a perspective view of a fifth connector in accordance with the invention.

The connectors 10 and 50 of the FIGS. 1–3 embodiments are female in configuration. FIGS. 4, 5 and 6 show male connectors 60, 62 and 64 in accordance with the invention. The connector 60 utilizes the same configuration bus 14 as in the FIGS. 1–2 embodiment, but a pin contact 66 extends from and is solder reflow bonded to the opening 30 in the bus 14. Conventional solid copper pin contacts 68 are solder reflow bonded to extend through apertures 22 in the bus 14. Such solid pin contacts 68 may be used in the connector of this invention when it is desired to solder reflow bond the connector to a printed circuit board. The pin contact 66 is configured to engage a socket of a female connector in accordance with the invention, such as the sockets 32 and 52 in the FIGS. 1–3 embodiment. The pin contact 66 may be plugged into conventional sockets as well. The pin contact 66 of the connector 60 extends from end 70 of the insulator block 72.

In the connector 62 of FIG. 5, pin 66 extends from top 74 of the insulation block 72, and is solder reflow bonded to extend from aperture 54 of the bus 56. Compliant pins 20 are utilized in the connector 62 as in the FIGS. 1–3 embodiments.

In the connector 64 of FIG. 6, the pin contact 66 extends from side 76 of the insulator block 72 and is solder reflow bonded to extend through aperture 78 in the bus 80. Other than as shown and described, the construction and operation of the connector 64 is the same as the connectors 60 and 62 of FIGS. 4 and 5.

The connectors 10, 50, 60, 62 and 64 can be used as mating pairs, pin and socket, or the male connectors 60, 62 and 64 can be used in conjunction with bus structure 100 discussed below in connection with FIG. 7, as in mother board/daughter board interfaces, discussed below in connection with FIG. 8. When used in mating pairs, the pin and socket combination selected from connectors 10, 50, 60, 62 and 64 is rated at 75 amperes with only a 6 millivolt drop. The connectors 10, 50, 60, 62 and 64 are designed and manufactured in the same manner as the bus structure 100, that is, the socket connectors 10 and 50 utilize the same crown contacts, the same insulation block, the same locking mechanism, the same PCB pins, and also can be configured with the same wide variety of options as the bus structure 100. When the connectors 10, 50, 60, 62 and 64 are used in a board to board bus interconnect structure, the locking feature may not be required and can be omitted in the manufacturing process.

Figure 7:
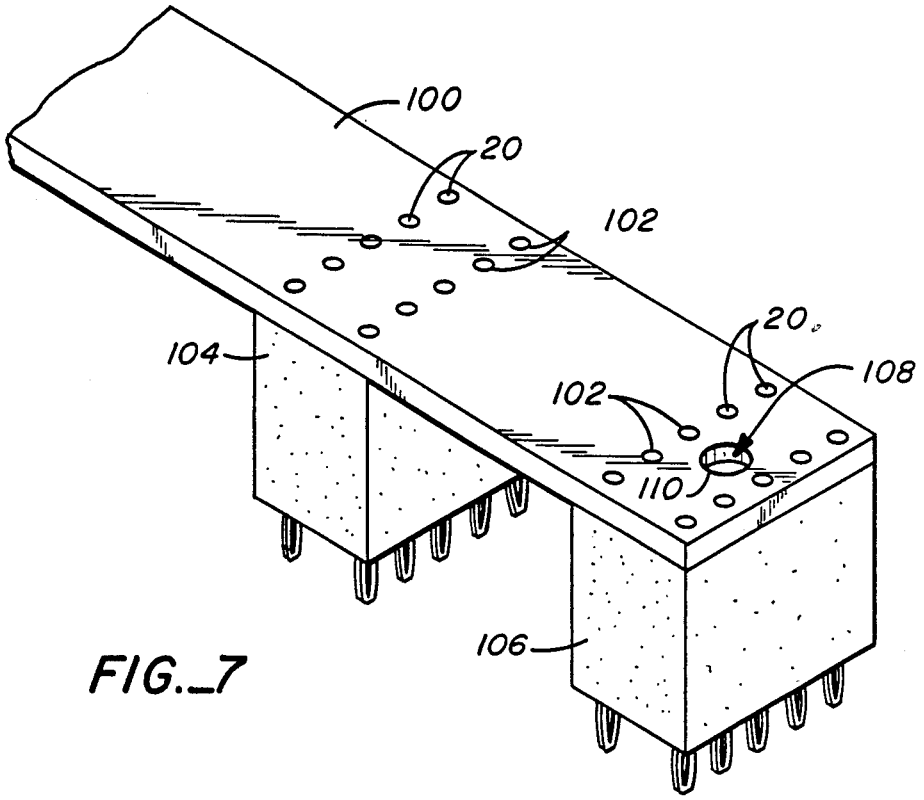
FIG. 7 is a perspective view of a bus structure in accordance with the invention.

The connector of this invention can also be ganged on the bus 100, as shown in FIG. 7. The compliant pins 20 are solder reflow bonded to extend through apertures 102 in the bus 101 in sets of 10 in standard DIP configuration through insulator blocks 104 and 106. Where an additional electrical contact to the connector element is not required, such as at the insulator block 104, a socket or separate contact pin is not provided. Socket 108 extends through opening 110 in the bus 101 into insulator block 106 to allow a further electrical connection to that connector assembly. The socket 108 has the same configuration as the socket 32 shown in FIGS. 1–2. The bus structure of this invention can be provided in any ganged configuration to meet a user's requirements, in addition to the configuration shown in FIG. 7. The bus structure 100 can be configured with a wide range of contact sizes depending on electrical performance required. The bus structure 100 station pins 20 (10 per station) are centered on 0.100" by 0.300" centers, which complies with industry standard DIP spacings. The bus structure 100 can be manufactured to any length and with any combination of stations as required by the user.

Figure 8:
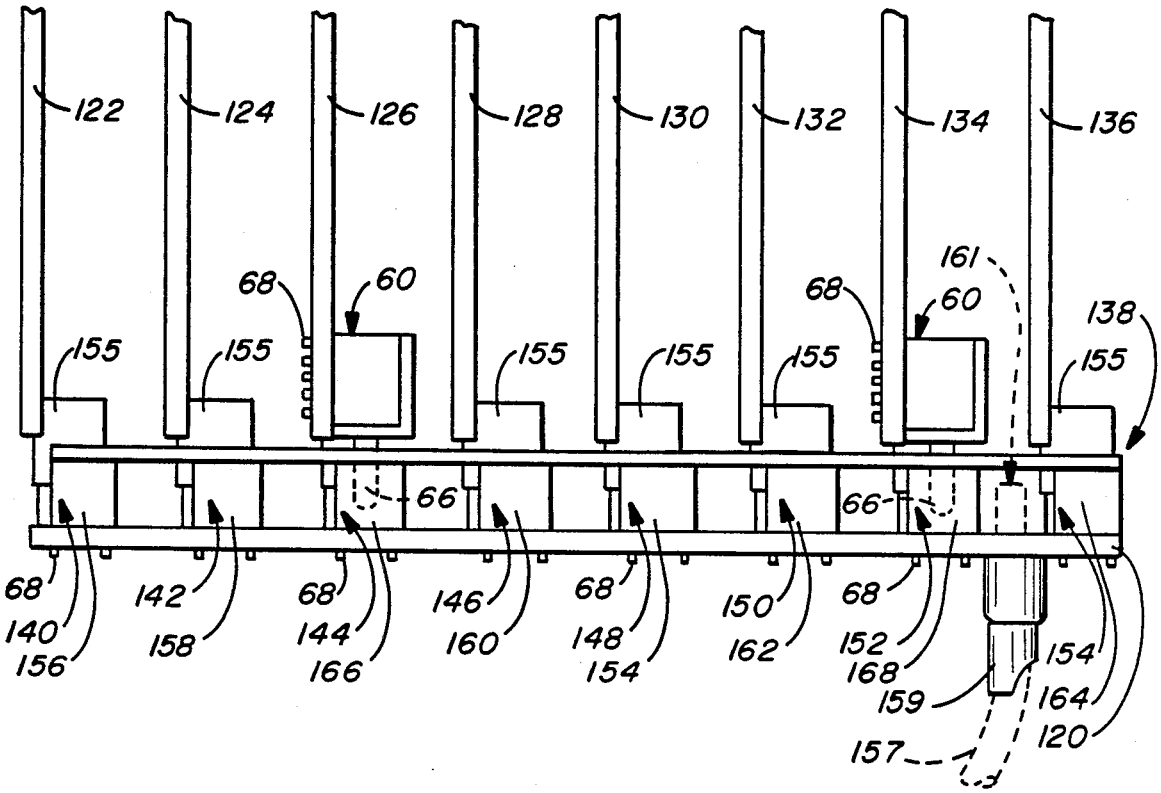
FIG. 8 is a side view of an interconnected printed circuit board system in accordance with the invention.

FIG. 8 shows how the connector and bus structure of this invention is used to interconnect printed circuit mother board 120 and daughter boards 122, 124, 126, 128, 130, 132, 134 and 136. Bus 138 is of the type shown in FIG. 7 except that solid copper pins 68 for solder reflow bonding are employed, and is connected to the mother board 120 by means of connectors 140, 142, 144, 146, 148, 150, 152 and 154. Blocks 156, 158, 160, 162, and 164 of the connectors 140, 142, 146, 148, 150, and 154 are configured in the same manner as the block 104 in FIG. 7. Blocks 166 and 168 of connectors 144 and 152 are configured in the same manner as block 106 in FIG. 7. Connectors 60 have their pin contacts 66 plugged into the connectors 144 and 152 and their pins 68 solder reflow connected to the circuit boards 126 and 134. The daughter boards 122–136 are also connected to the mother board 120 with standard DIN edge connectors 155. Power cable 157 is connected by discrete male connector 159 and female connector 161 to the bus 138.

In the system of FIG. 8, power supplied to the bus 138 from the cable 156 is supplied to the daughter boards 126 and 134 through the connectors 60. Power is supplied through the connectors 140–154 to the mother board 120 and the daughter boards 122–136. A system of the type shown in FIG. 8 is highly flexible in the arrangement and connections to the mother board and daughter boards through the bus structure and connectors of this invention.

The bus structures shown in FIGS. 7 and 8 comprise a power distribution system including male and female electrical contacts housed in a package which is mountable to a single or multi-layer printed circuit board. The bus structure design provides for variable design applications and uses. That is, the bus structure can be configured to fit the user's unique packaging and interface requirements. The bus structure provides a series of connections made to circuit boards via either compliant pins or solid pin contacts, for solder reflow bonding through plated through holes in the circuit board. The bus structure includes two or more stations on predetermined, but variable, center spacings. Each station can have a set of ten compliant or solid pins for electrical connection by insertion into a printed circuit board. Each station can have an integral female contact utilizing crown contact technology. If a station has such a female contact, it must also have a set of 10 pins for insertion into a printed circuit board. At the user's option, stations can be left blank, having only the bus itself for bridging adjacent stations, or stations may be loaded with 10 pins for board mounting, but without a socket contact as part of that station.

Whenever a station has a compliment of 10 pins for printed circuit board mount, it must also include an insulation block through which the 10 pins are inserted so they protrude a predetermined distance from the bottom surface for acceptable printed circuit board mounting. The insulation block spaces the bus bar a predetermined height from the circuit board to give good insulation between them. It provides mechanical support for the pins, whether compliant or solid.

Figure 9:
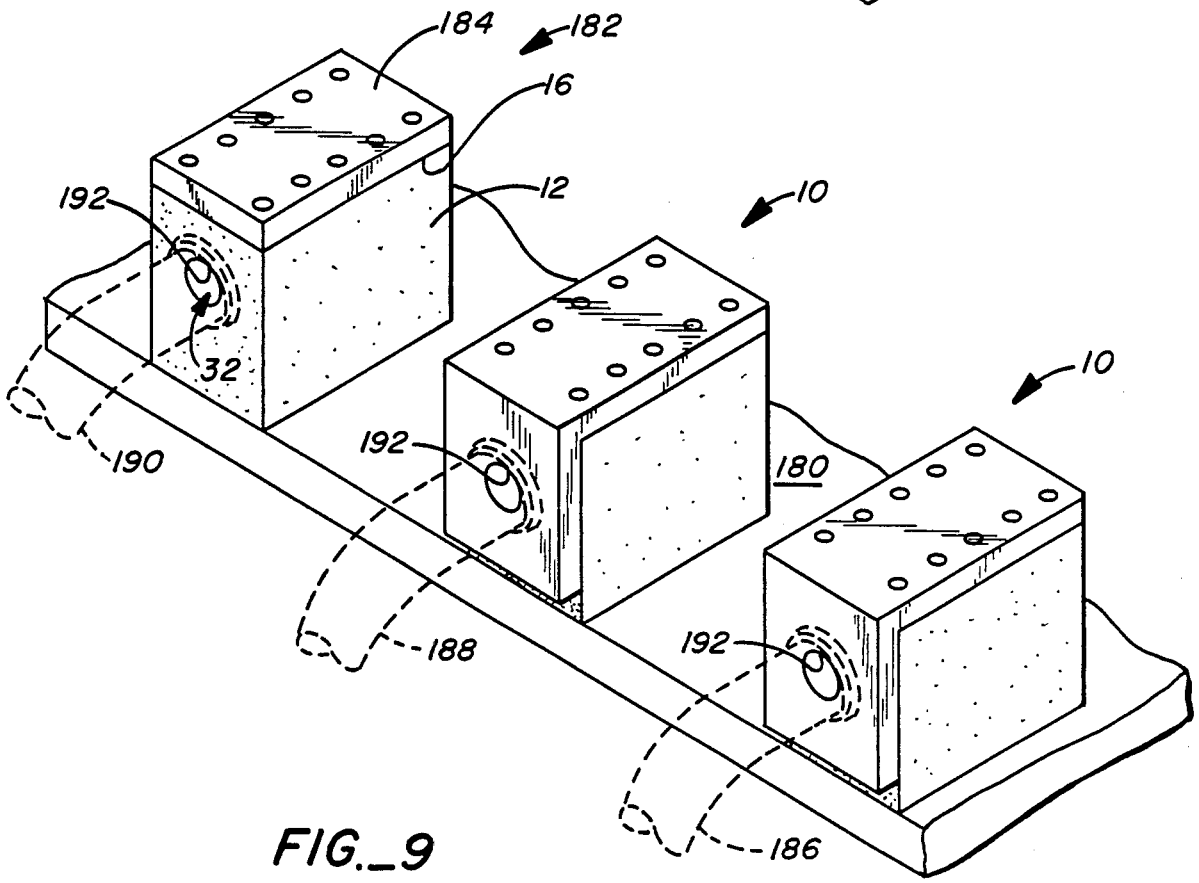
FIG. 9 is a perspective view showing further use of a connector in accordance with the invention.

FIG. 9 shows another way in which connectors 10 may be employed with a circuit board 180. A dummy connector 182 is configured in the same manner as the connectors 10, except that socket 32 is empty and bus 184 covers only top 16 of the insulator base 12. Different pairs of the power cables 186, 188 and 190 are connected to the circuit board 180 through their discrete pin connectors 192 and the two connectors 10. The third of the power cables 186, 188 or 190 not so connected is stored by plugging its connector 192 into the socket 32 of the dummy connector 182. The connections to the circuit board 180 are easily changed by exchanging one of the cables 186 or 188 with the cable 190 plugged into the dummy connector 182.

It should now be readily apparent to those skilled in the art that a novel connector, bus structure and printed circuit board interconnection system capable of achieving the stated objects of the invention has been provided. This connector, bus stucture and interconnection system are easily connected and disconnected in a variety of configurations to meet specialized design requirements. Standard configuration parts are utilized to make different connectors. The bus structure utilizes the connectors to provide essentially any board/board interplanar relationship.

It should further be apparent to those skilled in the art that various changes in form and detail of the invention as shown and described may be made. It is intended that such changes be included within the spirit and scope of the claims appended hereto.

What is claimed is:

1. A power distribution connector system, which comprises first and second power distribution connectors each having an insulating block with a plurality of rectangular surfaces, a bus element supported on and covering at least one of the rectangular surfaces of said insulating block, a plurality of contact pins attached to said bus element and extending through said insulating block to an opposite rectangular surface of said insulating block from the at least one rectangular surface of said insulating block supporting said bus element, and an additional contact electrically connected to said bus element and configured to engage a mating contact, said additional contact of said first power distribution connector comprising a generally cylindrical male contact extending outward from said bus element of said first power distribution connector and being configured as the mating contact for the additional contact of said second power distribution connector, said insulating block of said second power distribution connector having a socket which extends from said bus element into said insulating block of said second power distribution connector, said additional contact of said second power distribution connector comprising a female contact extending into said insulating block of said second power distribution connector and being configured as the mating contact for the additional contact of said first power distribution connector.

2. The power distribution connector system of claim 1 in which said socket of said second power distribution connector extends from said bus element of said second power distribution connector into said insulating block of said second power distribution connector parallel to an extending direction of said contact pins of said second power distribution connector.

3. The power distribution connector system of claim 1 in which said additional, female contact of said second power distribution connector is generally cylindrical in shape with a centrally disposed segment along a length of the cylinder having a reduced diameter, said additional, female contact of said second power distribution connector being formed from a spring conductive metal.

4. A power distribution connector, which comprises an insulating block, a bus element supported by said insulating block, a plurality of contact pins attached to said bus element and extending through said insulating block, and an additional contact eletrically connected to said bus element and configured to engage a mating contact, said insulating block having a socket which extends from said bus element into said insulating block, said additional contact being a female contact in said socket, said additional, female contact being generally cylindrical in shape with a centrally disposed segment along a length of the cylinder having a reduced diameter, said additional, female contact being formed from a spring conductive metal and a conductive contact housing in said socket, said additional, female contact being friction fit in said contact housing, said contact housing having a rim extending from said socket to engage said bus element.

5. The power distribution connector of claim 4 in which the rim of said contact housing has an annular cavity on an inside surface of the rim, said connector additionally comprising a split, resilient ring in the annular cavity, said ring being configured to expand when the mating contact is inserted in said socket and to engage a locking groove on the mating contact when the mating contact is fully inserted in said socket.

6. A power distribution connector, which comprises an insulating block having a plurality of rectangular surfaces, a bus element supported on and covering at least one of the rectangular surface of said insulating block, a plurality of contact pins attached to said bus element and extending through said insulating block to an opposite rectangular surface of said insulating block from the at least one rectangular surface of said insulating block supporting said bus element, and an additional contact electrically connected to said bus element and configured to engage a mating contact, said additional contact being a generally cylindrical male contact fixedly attached to said bus element and extending perpendicularly outward away from said insulating block, said bus element being supported by two surfaces of said insulating block and said additional, male contact extending outward perpendicularly to an extending direction of said plurality of contact pins.

7. The power distribution connector of claim 6 in which said plurality of contact pins have a compliant end portion extending beyond a surface of said insulating block away from said bus element.

8. A power distribution connector combination, which comprises a plurality of insulating blocks each having a plurality of rectangular surfaces, a bus element supported on and covering at least one of the rectangular surfaces of said insulating block, a plurality of contact pins attached to said bus element and extending through said insulating block to an opposite rectangular surface of said insulating block from the at least one rectangular surface of said insulating block supporting said bus element, and an additional contact electrically connected to said bus element and configured to engage a mating contact, said insulating block having a socket which extends from said bus element into said insulating block and said additional contact being a female contact in said socket, said additional, female contact being generally cylindrical in shape, said bus element being configured as a bus structure in which said bus element extends between and is supported by said plurality of insulating blocks, said bus element having a planar lower surface resting on and covering one of said rectangular surfaces of each of said plurality of insulating blocks.

9. In combination, first and second printed circuit boards and first and second power distribution connectors, each of said first and second power distribution connectors comprising an insulating block having a plurality of rectangular surfaces, a bus element supported on and covering at least one of the rectangular surfaces of said insulating block, a plurality of contact pins attached to said bus element and extending through said insulating block to an opposite rectangular surface of said insulating block from the at least one rectangular surface of said insulating block supporting said bus element, and an additional contact electrically connected to said bus element and configured to engage a mating contact, said additional contact of said first power distribution connector comprising a generally cylindrical male contact extending outward from said bus element of said first power distribution connector and being configured as the mating contact for the additional contact of said second power distribution connector, said insulating block of said second power distribution connector having a socket which extends from said bus element into said insulating block of said second power distribution connector, said additional contact of said second power distribution connector comprising a female contact extending into said insulating block of said second power distribution connector and being configured as the mating contact for the additional contact of said first power distribution connector, said first power distribution connector being electrically connected to said first printed circuit board by said plurality of contact pins of said first power distribution connector and said second power distribution connector being electlrically connected to said second printed circuit board by said plurality of contact pins of said second power distribution connector, the additional contacts of said first and second power distribution connectors bieng connected together in mating electrical contact.

10. In combination, a printed circuit board and a power distribution connector, which comprises an insulating block having a plurality of rectangular surfaces, a bus element supported on and covering at least one of the rectangular surfaces of said insulating block, a plurality of contact pins attached to said bus element and extending through said insulating block to an opposite rectangular surface of said insulating block from the at least one rectangular surface of said insulating block supporting said bus element, and an additional contact electrically connected to said bus element and configured to engage a mating contact, said power distribution connector being electrically connected to said printed circuit board, in which said printed circuit board is configured for electrical connection to at least two of said power distribution connectors, there are at least two of said power distribution connectors electrically connected to and mounted on said printed circuit board, at least three power cables positioned to be selectively connected to said power distribution connectors, each of said power cables having a mating contact configured to engage said additional contact of said power distribution connectors, and a storage device for a one of said power cables, which comprises an additional insulating block, an additional bus element supported by said insulating block, an additional plurality of contact pins extending through said additional insulating block and mounting said additional insulating block and said additional bus element on said printed circuit board, and a socket in said additional insulating block free of electrical contact to said additional bus element and said additional plurality of contact pins.

11. In combination, first and second printed circuit boards and first and second power distribution connectors, each of said first and second power distribution connectors comprising an insulating block having a plurality of rectangular surfaces, a bus element supported on and covering at least one of the rectangular surfaces of said insulating block, a plurality of contact pins attached to said bus element and extending through said insulating block to an opposite rectangular surface of said insulating block from the at least one rectangular surface of said insulating block supporting said bus element, and an additional contact electrically connected to said bus element and configured to engage a mating contact, said additional contact of said first power distribution connector comprising a generally cylindrical male contact extending outward from said bus element of said first power distribution connector and being configured as the mating contact for the additional contact of said second power distribution connector, said insulating block of said second power distribution connector having a socket which extends from said bus element into said insulating block of said second power distribution connector, said additional contact of said second power distribution connector comprising a female contact extending into said insulating block of said second power distribution connector and being configured as the mating contact for the additional contact of said first power distribution connector, said first power distribution connector being electrically connected to said first printed circuit board by said plurality of contact pins of said first power distribution connector and said second power distribution connector being electrically connected to said second printed circuit board by said plurality of contact pins of said second power distribution connector, in which said first printed circuit board is a mother board, said second printed circuit board is a daughter printed circuit board electrically connected to said mother board, one of said first and second power disribution connectors is configured as a bus structure in which said bus element of said one of said first and second power distribution connectors extends between and has a planar surface supported by a plurality of said insulating blocks, said plurality of contact pins of said one of said first and second power distribution connectors extends from said bus element of said one of said first and second power distribution connectors through said plurality of said insulating blocks to mount said bus structure one of said first and second power distribution connectors on said mother board, another of said first and second power distribution connectors being electrically connected between said bus structure one of said first and second power distribution connectors and said at least one daughter printed circuit oard, the additional contacts of said first and second power distribution connectors being connected together in mating electrical contact.

12. The combination of claim 11 in which said bus structure one of said first and second power distribution connectors is said second power distribution connector, and said another of said first and second power distribution connectors is said first power distribution connector.

13. A power distribution connector, which comprises an insulating block having a plurality of rectangular surfaces, a bus element supported on and covering at least one of the rectangular surfaces of said insulating block, a plurality of contact pins attached to said bus element and extending through said insulating block to an opposite rectangular surface of said insulating block from the at least one rectangular surface of said insulating block supporting said bus element, and an additional contact electrically connected to said bus element and configured to engage a mating contact, said insulating block having a socket which extends from said bus element into said insulating block and said additional contact being a female contact in said socket, said additional, female contact being generally cylindrical in shape with a centraly disposed segment along a length of the cylinder having a reduced diameter, said additional, female contact being formed from a spring conductive metal.

14. The power distribution connector of claim 13 in which said bus element is supported by two surfaces of said insulating block, said plurality of pins extend from said bus element through said insulating block at one of the two surfaces and said socket extends from said bus element into said insulating block at another one of the two surfaces.

15. The power distributionc onnector of claim 13 in whcih said socket exends from said bus element into said insulating block parallel to an extending direction of said contact pins.

* * * * *